US006390788B1

(12) United States Patent
Tack

(10) Patent No.: US 6,390,788 B1
(45) Date of Patent: May 21, 2002

(54) WORKING-FLUID INTAKING STRUCTURE FOR HERMETIC COMPRESSOR

(75) Inventor: Kyung-Sick Tack, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/622,786

(22) PCT Filed: Dec. 29, 1999

(86) PCT No.: PCT/KR99/00833

§ 371 Date: Aug. 23, 2000

§ 102(e) Date: Aug. 23, 2000

(87) PCT Pub. No.: WO00/40862

PCT Pub. Date: Jul. 13, 2000

(30) Foreign Application Priority Data

Dec. 31, 1998 (KR) ..... 98-28349 U

(51) Int. Cl.[7] ..... F04B 53/00
(52) U.S. Cl. ..... 417/312; 181/403
(58) Field of Search ..... 417/312, 313, 417/902; 181/403

(56) References Cited

U.S. PATENT DOCUMENTS 5,888,055 A * 3/1999 Lee ..... 417/312

FOREIGN PATENT DOCUMENTS

JP 61-113982 7/1986
JP 2-56876 3/1990
KR 97-6889 2/1997

* cited by examiner

*Primary Examiner*—Charles G. Freay
(74) *Attorney, Agent, or Firm*—Fleshner & Kim, LLP

(57) ABSTRACT

The object of this invention is to provide a working-fluid intaking structure for hermetic compressors. In the working-fluid intaking structure for hermetic compressors of this invention, a coupling cap (20) connects a suction muffler (9) to a suction pipe (10), with a plurality of external and internal pressure projections (25 and 25') regularly formed on the external and internal surfaces of the coupling cap (20). Of the two types of pressure projections (25 and 25'), the external projections (25) come into close contact with the internal surface of a cylindrical suction port (9') of the suction muffler (9), while the internal projections (25') come into close contact with the external surface of a coil spring (12) that connects the suction pipe (10) to the coupling cap (20). The pressure projections (25 and 25') thus firmly hold the coupling cap (20) at a desired position in the suction muffler (9). The above pressure projections (25 and 25') are regularly and alternately formed on the external and internal surfaces of a tubular body (21) constituting the coupling cap (20). The working-fluid intaking structure for hermetic compressors of this invention preferably simplifies the structure for leading the working-fluid from the outside of a hermetic compressor into the suction muffler, thereby accomplishing the recent trend of compactness, smallness and lightness of the compressor while accomplishing a desired rigidity of such a suction structure. The working-fluid intaking structure of this invention is also very easily assembled during a production process of such hermetic compressors.

20 Claims, 4 Drawing Sheets

WORKING-FLUID INTAKING STRUCTURE FOR HERMETIC COMPRESSOR

TECHNICAL FIELD

The present invention relates, in general, to hermetic compressors and, more particularly, to a working-fluid intaking structure for such hermetic compressors designed to directly feed sucked working-fluid to a suction muffler within a hermetic compressor.

BACKGROUND ART

FIG. 1 shows the internal construction of a conventional hermetic compressor. As shown in the drawing, the conventional hermetic compressor comprises a hermetic housing 1 consisting of upper and lower casings 1*t* and l*b*, with a frame 2 being set within the housing 1. A stator 3 is fixedly mounted to the frame 2. Such a frame 2 is held in the hermetic housing 1 by a spring 2S.

A crankshaft 5 is installed within the housing 1 while passing through the central portion of the frame 2, while a rotor 4 is integrated with the crankshaft 5 into a single structure. The above rotor 4 is electromagnetically rotated along with the crankshaft 5 in cooperation with the stator 3. An eccentric pin 5*b* is provided on the upper end of the crankshaft 5 while being eccentric from the rotating axis of the crankshaft 5. The construction of the eccentric pin 5*b* will be described in more detail later herein.

On the other hand, a cylinder 6, having a compression chamber 6', is integrated with the frame 2 into a single structure, with a piston 7 being set in the compression chamber 6' of the cylinder 6. The above piston 7 is connected to the eccentric pin 5*b* of the crankshaft 5 through a connecting rod 8.

A suction muffler 9 is installed within the hermetic housing I while communicating with the compression chamber 6' of the cylinder 6, with a suction pipe 10 being directly coupled to the suction muffler 9 through a coupling cap 11. The object of the above suction muffler 9 is to reduce operational noises of the working-fluid, sucked from the outside of the compressor into the compressor housing 1, prior to feeding the working-fluid to the compression chamber 6' of the cylinder 6. The coupling structure between the coupling cap 11 and the suction muffler 9 is shown in detail in FIG. 2. As shown in the drawing, the coupling cap 11, having a predetermined shape, is inserted into the suction port 9' of the suction muffler 9, while the suction pipe 10 is coupled to the coupling cap 11 using a spring 12.

A stop projection 11*j* is formed on the upper end portion of the above coupling cap 11, and so the coupling cap 11 is caught by the interior surface of the suction muffler 9 at the stop projection 11*j* when the coupling cap 11 is fully inserted into the suction port 9' of the suction muffler 9. A limit projection 11*s* is formed at the lower end portion of the coupling cap 11 and limits the insertion of the cap 11 into the suction port 9' of the muffler 9. The lower end portion of the coupling cap 11 is gradually and linearly enlarged in diameter in a direction from the limit projection 11*s* to the distal end.

On the other hand, the spring 12 is fully inserted into the coupling cap 11 at one end thereof and is fitted over the upper end of the suction pipe 10 at the other end thereof. Such a spring 12 normally biases the cap 11 toward the suction muffler 9, thus elastically holding the cap 11 relative to the suction muffler 9 while absorbing and releasing operational vibration of the compressor.

In the drawings, the reference numeral 13 denotes an exhaust muffler that is used for reducing operational noises of compressed refrigerant exhausted from the compression chamber 6', and the reference character L denotes oil used for lubricating and cooling the parts of the compressor.

In an operation of the above conventional compressor, working-fluid is introduced into the compression chamber 6' of the cylinder 6 as follows. That is, the working-fluid orderly passes through the suction pipe 10 and the coupling cap 11 prior to being introduced into the suction muffler 9. The working-fluid is reduced in operational noises while passing through the suction muffler 9 and flows into the compression chamber 6' of the cylinder 6.

However, the above conventional hermetic compressor is problematic as follows.

That is, the coupling cap 11 is elastically inserted into and held in the suction port 9' of the suction muffler 9 due to its own elasticity, and so it is necessary for both the coupling cap 11 and the suction port 9' to have precise dimensions. However, the size of the coupling cap 11 may be larger than that of the suction port 9' in an effort to accomplish a desired machining allowance. In this case, it is very difficult to assemble the coupling cap 11 with the suction port 9' of the suction muffler 9.

On the other hand, when the size of the coupling cap 11 is exceedingly smaller that of the suction port 9', the coupling cap 11 may be undesirably moved within the suction port 9' during an operation of the compressor. This finally undesirably induces vibration to the parts that are operated in conjunction with the coupling cap 11, thus reducing the operational reliability of the compressor. Such an exceedingly small cap 11 also forms undesirable metal powder within the suction port 9', the metal powder being formed by a frictional movement of the cap 11 relative to the suction port 9'.

DISCLOSURE OF THE INVENTION

Accordingly, the present invention has been made keeping in mind the above problems occurring in the prior art, and an object of the present invention is to provide a working-fluid intaking structure for hermetic compressors, which is designed to more firmly and stably connect the suction pipe to the suction muffler.

Another object of the present invention is to provide a working-fluid intaking structure for hermetic compressors, which allows the suction pipe to be more easily and simply connected to the suction muffler.

In order to accomplish the above object, the present invention provides a working-fluid intaking structure for hermetic compressors, comprising a working-fluid suction means set in a hermetic compressor while extending through the hermetic housing of the compressor, a suction muffler set in the hermetic housing and used for reducing operational noises of sucked working-fluid fed from the working-fluid suction means prior to feeding the working-fluid to a working-fluid compression part of the compressor, a coupling cap inserted into the suction muffler while being elastically held at a desired position of the suction muffler by an elastic member allowing the working-fluid suction means to communicate with the suction muffler; and a plurality of pressure projections formed on the coupling cap and used for firmly setting the coupling cap on the suction muffler.

In the working-fluid intaking structure, the pressure projections may be formed on at least one of the external and internal surfaces of the coupling cap so as to be brought into close contact with the internal surface of a suction port of the suction muffler and with the external surface of the elastic member. It is also preferable to axially form the pressure projections on the coupling cap.

In accordance with the working-fluid intaking structure for hermetic compressors of this invention, it is possible to easily and firmly set the coupling cap at a desired position of the suction muffler, with the coupling cap be used for connecting a suction pipe to the suction muffler.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
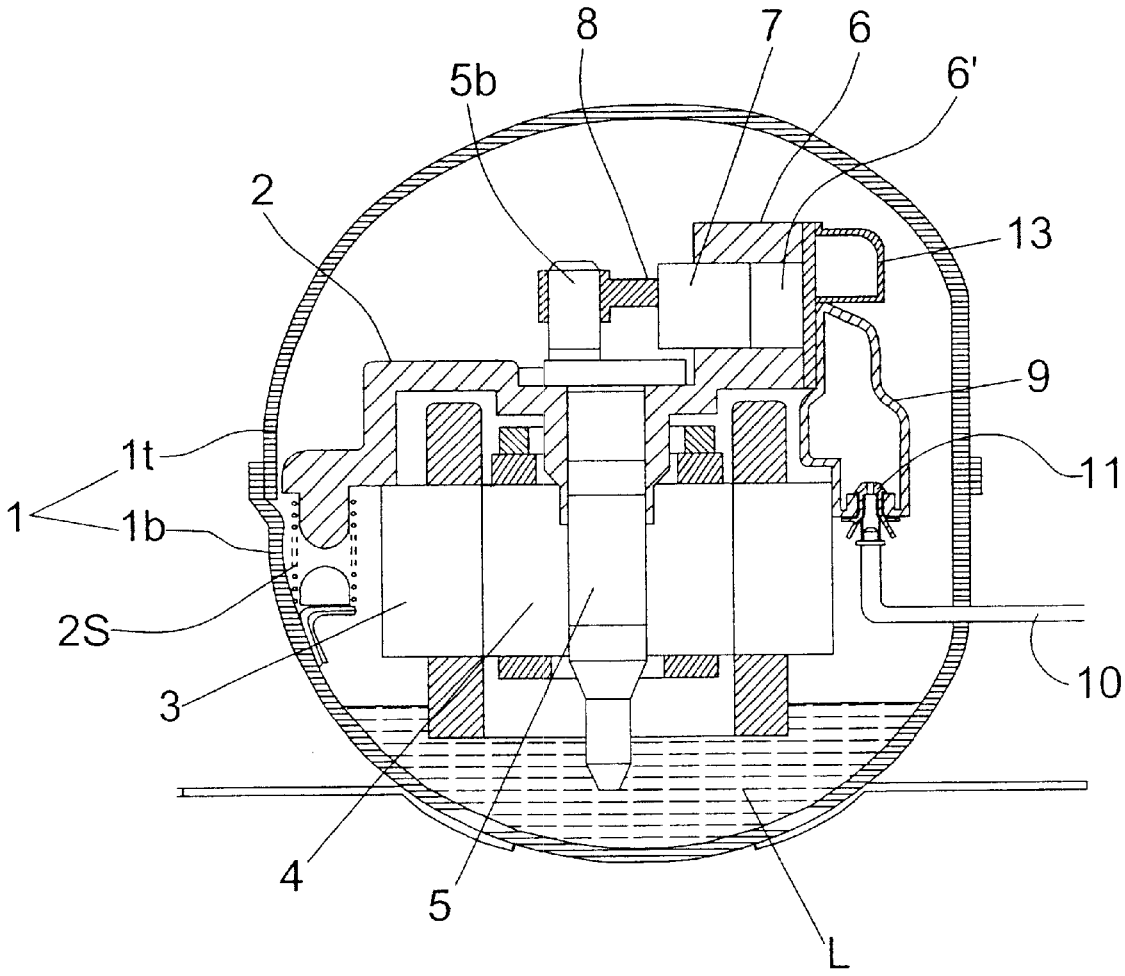
FIG. 1 is a sectional view, showing the internal construction of a conventional hermetic compressor.
Figure 2:
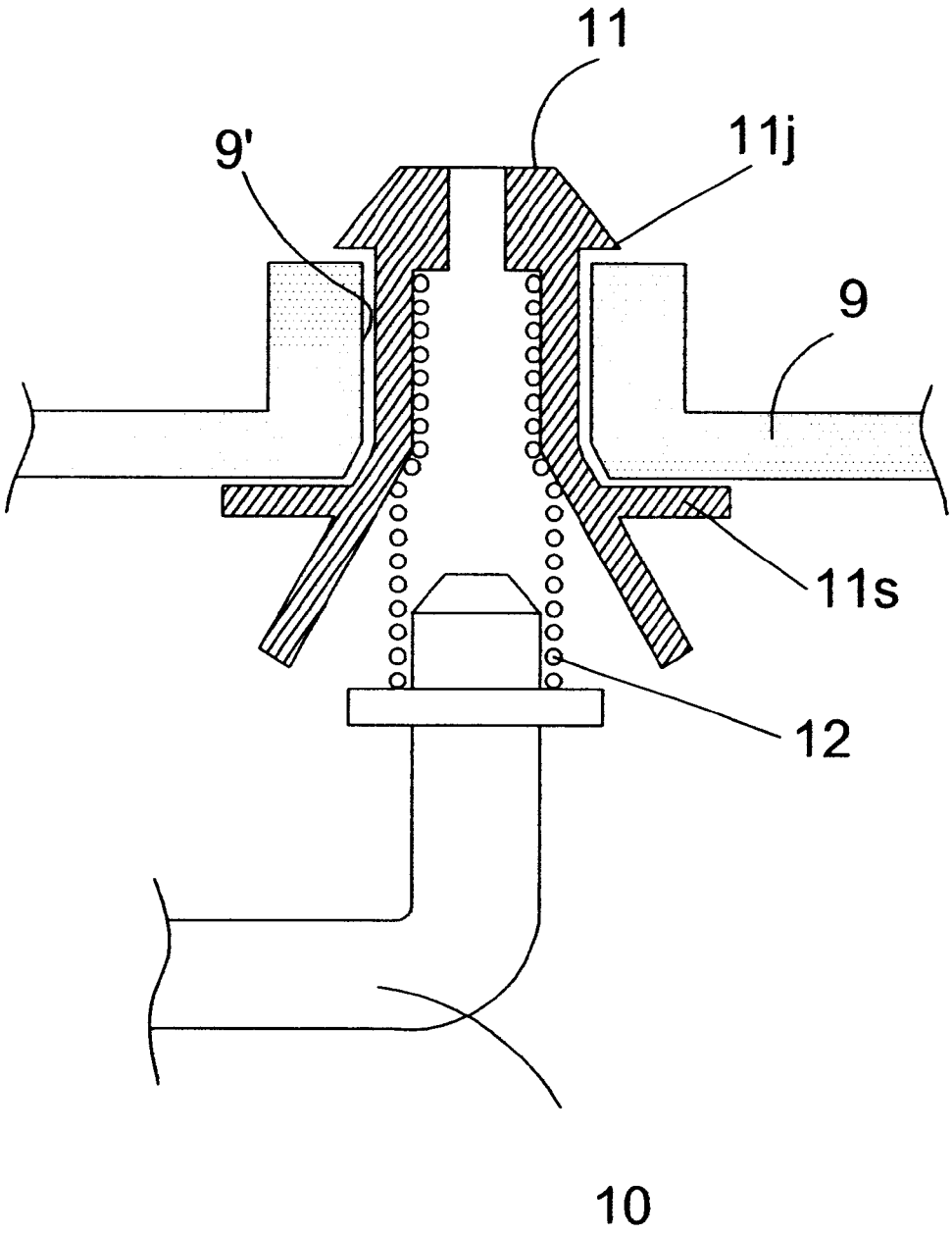
FIG. 2 is a sectional view of a conventional working-fluid suction structure used in the above hermetic compressor.

Reference now should be made to the drawings, in which the same reference numerals are used throughout the different drawings to designate the same or similar components.

FIGS. 3 to 6 show a working-fluid intaking structure for hermetic compressors in accordance with the preferred embodiment of this invention. As shown in the drawings, a coupling cap 20 is inserted into the suction port 9' of the suction muffler 9, with a fluid passage 22 being formed within the tubular body 21 of the coupling cap 20 and allowing a suction pipe 10 to communicate with the interior of the suction muffler 9.

Figure 4:
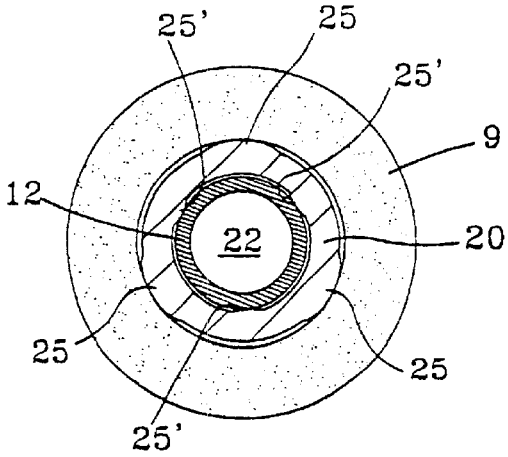
FIG. 4 is a sectional view of the working-fluid intaking structure of this invention taken along the line A–A' of FIG. 3.
Figure 5:
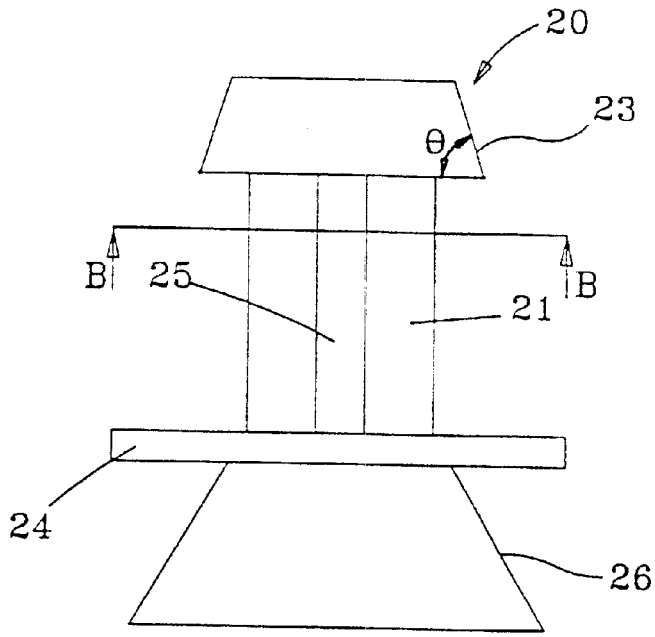
FIG. 5 is a front view of the working-fluid intaking structure according to the present invention.

A guide stopper 23 is formed on the upper end portion of the tubular body 21 of the cap 20. This guide stopper 23 is tapered on its sidewall in a way such that the diameter of the stopper 23 is gradually and linearly increased in a direction from the top end to the lower end. The guide stopper 23 thus allows the cap 20 to be more smoothly inserted into the suction port 9' of the suction muffler 9. In order to accomplish the above-mentioned object of the tapered shape of the guide stopper 23, it is necessary to form the tapered angle of the guide stopper 23 of not less than 70°. On the other hand, when the coupling cap 20 is fully inserted into the suction port 9' of the suction muffler 9, the lower end of the tapered guide stopper 23 is caught by the interior surface of the suction muffler 9 as shown in FIG. 4, thus preventing the coupling cap 20 from being undesirably removed from the suction muffler 9.

A lower stopper 24 is formed at the lower end portion of the tubular body 21 of the coupling cap 20 and is brought into close contact with the external surface of the suction muffler 9, thus limiting the insertion of the cap 20 into the suction muffler 9. The lower end portion of the coupling cap 20 is gradually and linearly enlarged in diameter in a direction from the lower stopper 24 to the distal end, thus forming a diffusing end portion 26.

On the other hand, a plurality of external and internal pressure projections 25 and 25' are regularly formed on the external and internal surfaces of the tubular body 21 of the coupling cap 20. Of the two types of pressure projections 25 and 25', the external projections 25 come into close contact with the internal surface of the cylindrical suction port 9' of the suction muffler 9 as best seen in FIG. 4. The internal projections 25' come into close contact with the external surface of the coil spring 12 that is set within the fluid passage 22 of the coupling cap 20. The pressure projections 25 and 25' come into close contact with the suction port 9' and the spring 12, thus firmly holding the coupling cap 20 at a desired position on the suction muffler 9.

Figure 6:
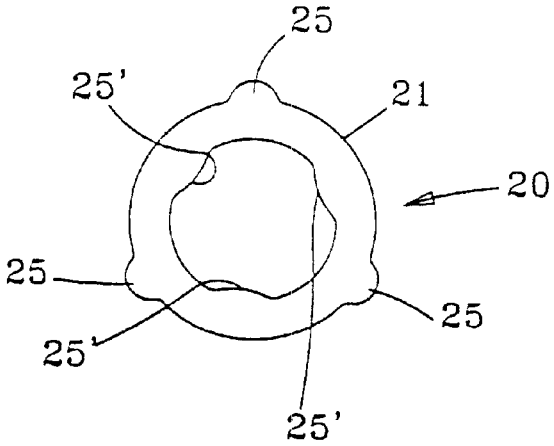
FIG. 6 is a sectional view of the working-fluid intaking structure of this invention taken along the line B–B' of FIG. 5.

The above pressure projections 25 and 25' are axially formed on the tubular body 21 of the coupling cap 20. As best seen in FIG. 6, the pressure projections 25 and 25' are regularly and alternately formed on the external and internal surfaces of the tubular body 21 of the coupling cap 20.

The above working-fluid intaking structure for hermetic compressors of this invention will be assembled and operated as follows.

The working-fluid intaking structure is assembled into a single body by setting the coupling cap 20 in the suction port 9' of the suction muffler 9 prior to inserting the spring 12 into the cap 12 so as to connect the suction pipe 10 to the suction muffler 9 through the coupling cap 20. In such a case, the coupling cap is primarily inserted into the suction port 9' from the guide stopper 23 of the cap 20. The guide stopper 23 has a desired elasticity, and so the stopper 23 smoothly passes through the suction port 9' while being elastically compressed. In addition, the tubular body 21 of the cap 20 is seated within the suction port 9', with the external projections 25 of the tubular body 21 being elastically compressed within the port 9'.

In a detailed description, the external projections 25 of the tubular body 21 are elastically compressed by the internal surface of the suction port 9'. Since the external projections 25 are projected on the external surface of the tubular body 21, the projections 25 are somewhat depressed in a radial direction toward the fluid passage 22 of the body 21 and are somewhat deformed in a circumferential direction of the tubular body 21 when the cap 20 is inserted into the suction port 9'. Therefore, only the external projections 25 are brought into contact with the internal surface of the suction port 9' during an insertion of the cap 20 into the suction port 9'. Due to the elastic external projections 25, it is easier to insert and set the coupling cap 20 into the suction port 9' of the suction muffler 9. After the coupling cap 20 is completely set within the suction port 9' of the suction muffler 9, the compressed external projections 25 somewhat elastically restore their original positions, thus being brought into close contact with the internal surface of the suction port 9'.

Figure 3:
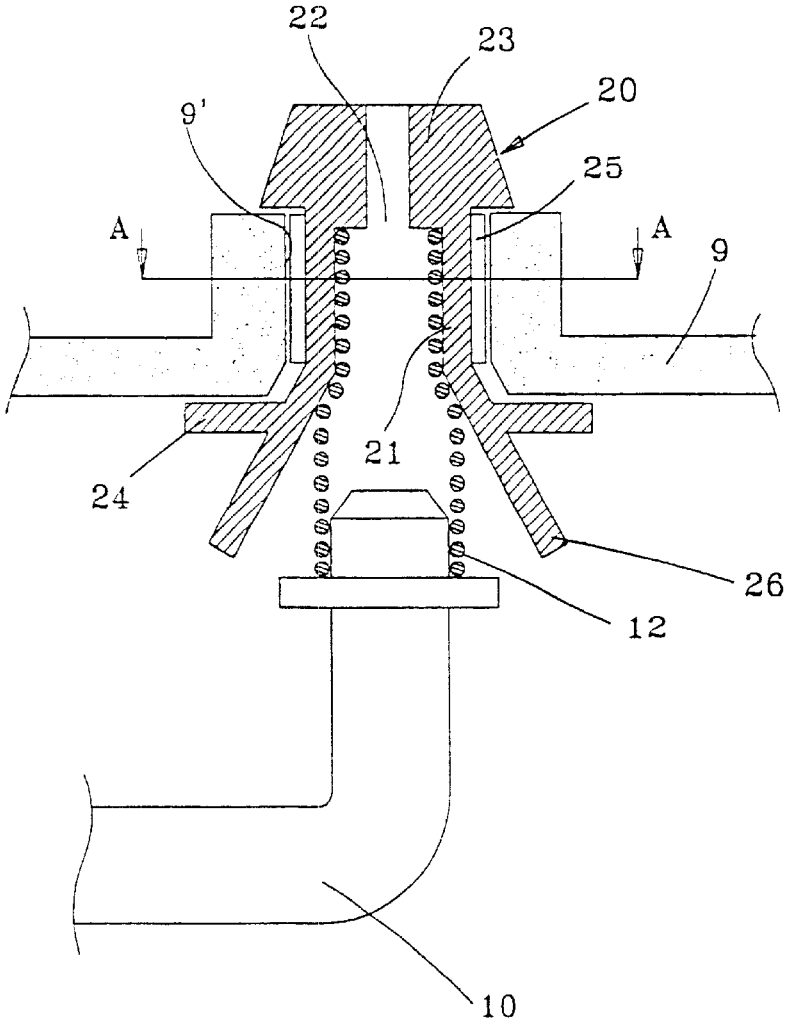
FIG. 3 is a sectional view of a working-fluid intaking structure for hermetic compressors in accordance with the preferred embodiment of the present invention.

When the coupling cap 20 is completely set within the suction port 9' of the suction muffler 9 as described above, the lower stopper 24 of the coupling cap 20 comes into close contact with the external surface of the suction muffler 9 as shown in FIG. 3, thus limiting the insertion of the cap 20 into the suction muffler 9.

On the other hand, the coil spring 12 is set in the fluid passage 22 of the coupling cap 20 and connects the suction pipe 10 to the suction muffler 9 through the cap 20. Since the internal projections 25' are regularly formed on the internal surface of the tubular body 21 of the coupling cap 20, it is possible to easily insert the spring 12 into the fluid passage 22 of the cap 20 without allowing the spring 12 from being undesirably removed from the cap 20. That is, when the coil spring 12 is inserted into the fluid passage 22 of the cap 20, the internal projections 25' are elastically forced by the spring 12 in a radial direction toward the external surface of the cap 20, thus being depressed toward the intermediate positions between the external projections 25 and allowing the spring 12 to be easily and smoothly inserted into a desired position within the fluid passage 22 of the coupling cap 20. After the spring 12 is completely set in the coupling cap 20, the internal projections 25' elastically restore their original positions, thereby firmly holding the position of the spring 12 within the coupling cap 20.

Therefore, when the coupling cap 20 is set in the suction port 9' of the suction muffler 9, the tubular body 21 of the cap 20 is brought into close contact with the internal surface of the suction port 9' at its external projections 25 and with the spring 12 at its internal projections 25', with the two types of projections being regularly and alternately formed on the tubular body 21. The coupling cap 20 is thus more firmly set on the suction muffler 9 and more firmly connects the suction pipe 10 to the suction muffler 9.

Industrial Applicability

As described above, the present invention provides a working-fluid intaking structure for hermetic compressors, which is designed to more firmly and stably connect a suction pipe to a suction muffler. In the working-fluid intaking structure of this invention, a plurality of external and internal pressure projections are axially, regularly and alternately formed on the external and internal surfaces of the tubular body of a coupling cap used for connecting the suction pipe to the suction muffler. Therefore, the external projections of the tubular body are brought into close contact with the internal surface of the suction port of the suction muffler, while the internal projections come into close contact with the external surface of the coil spring used for connecting the suction pipe to the coupling cap. It is thus possible to more firmly set the coupling cap in the suction port of the suction muffler. Since only the external and internal projections are brought into contact with the internal surface of the suction port and the external surface of the spring, it is possible to easily accomplish the process of inserting the coupling cap into the suction port of the suction muffler and of connecting the suction pipe to the suction muffler.

What is claimed is:

1. A working-fluid intaking structure for hermetic compressors, comprising:

working-fluid suction means for sucking working-fluid into a hermetic compressor while extending through a hermetic housing of said compressor;

suction muffler means for reducing operational noises of sucked working-fluid fed from said working-fluid suction means within the compressor prior to feeding the working-fluid to a working-fluid compression part of the compressor;

coupling cap means for allowing the working-fluid suction means to communicate with the suction muffler means, the coupling cap means being inserted into the suction muffler while being elastically held at a desired position on the suction muffler means by an elastic member; and a plurality of pressure projection means for firmly setting the coupling cap means on the suction muffler means, the plurality of pressure projection means being formed on an outer surface of said coupling cap means.

2. The working-fluid intaking structure according to claim 1, wherein said pressure projection means are formed on an external surface of said coupling cap means so as to be brought into close contact with an internal surface of a suction port of said suction muffler means.

3. The working-fluid intaking structure according to claim 1, wherein said pressure projection means are formed on an internal surface of said coupling cap so as to be brought into close contact with an external surface of said elastic member.

4. The working fluid intake structure according to claim 1, wherein the coupling cap is elastically held at a desired position on the suction member by an elastic member.

5. A working-fluid intake structure for hermetic compressors, comprising:

a working-fluid suction device positioned in a hermetic compressor and extending through a hermetic housing of the compressor;

a suction muffler configured to reduce operational noises of sucked working-fluid fed from the working-fluid suction device disposed within the hermetic compressor;

a coupling cap coupled to the suction muffler, the coupling cap providing communication between the working-fluid suction device and the suction muffler; and a plurality of pressure projections provided on a surface of the coupling cap and configured to firmly hold the coupling cap on the suction muffler.

6. The working-fluid intake structure according to claim 5, wherein the pressure projections are formed on an external surface of the coupling cap so as to be brought into close contact with an internal surface of a suction port of the suction muffler when the coupling cap is coupled thereto.

7. The working-fluid intake structure according to claim 5, wherein the coupling cap is elastically held at a desired position on the suction muffler by an elastic member.

8. The working-fluid intake structure according to claim 7, wherein the pressure projections are formed on an internal surface of the coupling cap so as to be brought into close contact with an external surface of the elastic member.

9. A fluid intake structure for compressors, comprising;

a fluid intake device extending through a housing of a compressor and configured to guide fluid into the compressor;

a muffler configured to reduce operational noise of the intake fluid;

a coupling cap coupled to the muffler, the coupling cap providing communication between the fluid intake device and the muffler; and a plurality of projections provided on a surface of the coupling cap and configured to firmly hold the coupling cap with respect to the muffler.

10. The fluid intake structure according to claim 9, wherein the coupling cap is elastically held at a predetermined position with respect to the muffler by an elastic member.

11. The fluid intake structure according to claim 9, wherein the plurality of projections are formed on an external surface of the coupling cap.

12. The fluid intake structure according to claim 9, wherein the plurality of projections are formed on an internal surface of the coupling cap.

13. The fluid intake structures according to claim 9, wherein the plurality of projections are formed on both an internal and an external surface of the coupling cap.

14. The fluid intake structure according to claim 9, wherein the coupling cap further comprises:

a first end in the form of a guide stopper;

a second end in the form of a diffusing end portion; and a cylindrical portion joining the first and second ends.

15. The fluid intake structure according to claim 14, wherein the plurality of projections are formed on an external surface of the cylindrical portion.

16. The fluid intake structure according to claim 14, wherein the plurality of projections are formed on an internal surface of the cylindrical portion.

17. The fluid intake structure according to claim 14, wherein the plurality of projections are formed on both an internal and external surface of the cylindrical portion.

18. The fluid intake structures according to claim 14, wherein the guide stopper has tapered sidewalls, the guide stopper increasing in diameter between a top end and a lower end.

19. The fluid intake structure according to claim 18, wherein an angle of the tapered sidewalls with respect to a central axis of the coupling cap is not less than approximately 70°.

20. The fluid intake structure according to claim 14, wherein the diffusing end portion includes a lower stopper.

* * * * *